United States Patent [19]

Doundoulakis

[11] 4,392,351

[45] Jul. 12, 1983

[54] MULTI-CYLINDER STIRLING ENGINE

[76] Inventor: George J. Doundoulakis, 2498 Kayron La., North Bellmore, N.Y. 11710

[21] Appl. No.: 124,518

[22] Filed: Feb. 25, 1980

[51] Int. Cl.[3] ..... F02G 1/04

[52] U.S. Cl. ..... 60/526; 60/519; 60/525; 165/169

[58] Field of Search ..... 60/517, 519, 648, 641.14, 60/526, 525, 650, 682; 165/76, 121, 169, 181

[56] References Cited

U.S. PATENT DOCUMENTS

| | | | |
|---|---|---|---|
| 3,218,807 | 11/1965 | Berchtold et al. | 60/650 |
| 3,890,787 | 6/1975 | Margen | 60/648 |
| 4,011,904 | 3/1977 | Hope et al. | 165/121 X |
| 4,167,856 | 9/1979 | Seidel et al. | 60/641.14 |
| 4,169,697 | 10/1979 | Doundoulakis | 418/34 |
| 4,179,890 | 12/1979 | Hanson | 60/519 X |
| 4,183,220 | 1/1980 | Shaw | 60/519 X |
| 4,209,061 | 6/1980 | Schwemin | 60/526 X |

*Primary Examiner*—Allen M. Ostrager
*Assistant Examiner*—Stephen F. Husar
*Attorney, Agent, or Firm*—Constantine A. Michalos; Peter C. Michalos

[57] ABSTRACT

A multi-cylinder Stirling engine comprises a stationary casing, working fluid, at least one heat source, a first heat exchanger for carrying the working fluid and for transferring heat from the heat source to the working fluid thereby raising the working fluid's temperature, and an output shaft rotatably supported by the stationary casing, which provides reaction surface members in at least one chamber where the working fluid is allowed to expand as the reaction members are allowed to move with respect to the casing. A bi-directional flow regenerator with two chambers, a second heat exchanger for further lowering the temperature of the working fluid to a predetermined temperature, and a compression device for returning the relatively cool and therefore dense working fluid back into the first heat exchanger at a lower expense of work are provided. The casing output shaft with reaction members, expansion chamber and compression device have a rotary engine configuration. This engine configuration operably providing eight power strokes per revolution, thereby greatly increasing the power output of the engine over conventional Stirling engines.

6 Claims, 7 Drawing Figures

MULTI-CYLINDER STIRLING ENGINE

BACKGROUND OF THE INVENTION

This invention utilizes some structure from the inventor's previous patents entitled Angular Compression Expansion Cylinder with Radial Pistons, U.S. Pat. No. 4,169,697; Internal Ballistic Engine, U.S. Pat. No. 4,167,922; Three Rotor Engine, U.S. Pat. No. 3,989,012; and Two Rotor Engine, U.S. Pat. No. 3,985,110.

FIELD OF THE INVENTION

The present invention relates in general to engines and in particular to a new and useful type of external combustion engine operable as a multi-cylinder Stirling Engine with modifications to improve the output power and the efficiency of the engine.

DESCRIPTION OF THE PRIOR ART AND APPLICABLE PHYSICAL PRINCIPLES

The Stirling cycle engine was originally invented by the Rev. Robert Stirling in 1816, and was extensively used for the operation of pumps. An important advantage of the Stirling engine over the internal combustion engines is that its heat supply is located externally to the walls of the expansion cylinder. In contrast with the internal combustion engines where the fuel is burned under high temperature and pressure, external combustion proceeds under the much lower atmospheric pressure and lower temperature so that the amount of $NO_x$ pollutants as a result of the fuel combustion is much smaller in the case of the Stirling engine. The absence of fuel detonations and extremely high pressures from the Stirling engine eliminates the loud noises of the internal combustion engines and thereby reduces the noise pollution.

The use of a heat regenerator principle, used by the Stirling engine, serves to increase the thermal efficiency of the engine to higher levels than the internal combustion engines can provide.

The basic structure of a Stirling engine comprises a hot chamber, a cold chamber and the regenerator. While the working fluid expands in the hot chamber, work is imparted to the piston. Then the hot gas is forced out of the hot chamber and into the cold chamber through the regenerator, which retains a good portion of the heat of the gas in its metallic mesh structure. The cold gas then, after it is further cooled in a heat exchanger, is returned to the hot chamber, again through the regenerator, from where it regains some of the heat. The reheated gas expands again to repeat the cycle.

The fuel burner which provides the heat energy to the engine is located next to the wall of the hot chamber so that its wall acts as a heat exchanger. The rate of failure of this wall is usually relatively high since it is being subjected to the high temperature of the flames of the burner, while its design is constrained to conform to the geometry of the hot cylinder of the engine.

Another disadvantage of the conventional Stirling engine is that the regenerator permits flow of the working fluid in a single direction at a time. This limits the operation of the engine to a single pair of cylinders, one used as a hot chamber, the other as a cold chamber, providing only a fraction of the horsepower available by same weight of internal combustion engines.

Another reason for the low horsepower output of the conventional Stirling engines is that the conventional Stirling engines inherently operates as lower speeds than the internal combustion engine. The reason for the lower speed is due to the Stirling engine's geometry. That is the fuel burner is located next to the hot cylinder thereby the heat exchanging process through the cylinder wall for heating the working fluid is relatively slow. A further reason for the low speed is the relative inefficiency of the heat exchanger which is now used to cool the working fluid to the low temperature.

Yet the Stirling engine concept is of extreme importance because it provides answers to several serious problems that face our society. One such problem is the high level of pollution emitted by the internal combustion engines to the extent that the present automotive Diesel engines cannot meet the U.S. pollution standards for the 1980's. A respectable institution, the Jet Propulsion Laboratories, Pasadena, California, has chosen the Stirling engine as the most promising engine for the future and has recommended substantial effort for its practical implementation. Besides the automotive need, an equally crucial need exists in our society for the conversion of heat to electricity for home use. On every house there is available free solar energy, a substantial portion of which can be converted to electricity. The presently available solar cells for direct conversion of solar energy to electricity can provide only half of the efficiency of a Stirling engine and at considerably higher cost. Yet the conventional Stirling engine because of the relatively small surface provided for the oil burner, would require a very high concentration factor in the solar collection system. As such a system would be highly intricate and expensive it becomes prohibitive on economical basis. The present invention physically separates the high temperature heat exchanger from the system so that, for example, a solar heat exchanger can take any desirable form on the roof of the house while the engine itself can be located in the basement of the house. The same Stirling engine system, if available at home, can convert a good portion of the energy of the home heating oil into useful electrical energy. Presently, the valuable energy content of the heating oil is being totally utilized towards the low grade energy of home heating. The electric power companies that use oil to produce electricity do this at an efficiency of around 30%, while they dump most of the remaining heat to the nearby river or sea water. The consumer is thus being charged for electricity per kilowatt hour several times the price of oil containing an equivalent amount of energy, because he is not getting any advantage of the 70% of the oil energy wasted by the electric power company.

The present invention, for example, can be used at home to convert about 40% of the free solar energy collected to mechanical work, quietly and without pollution. The available work can drive a generator which can convert the work to electrical energy, with an efficiency of about 80%. The combined efficiency of 32% is substantial. Besides, the 60% of the collected heat which has not been converted to mechanical work can be used by the homeowner for heating the house and for faucet hot water during the winter, while providing air-conditioning through an absorption type air-conditioner during the summer. It can be shown that a 400 square feet of sun tracking solar energy collecting system can provide sufficient heat to the system for generating an average of 40 KW hrs. per day, the electrical needs of an average home.

During the cloudy and dark hours a backup fuel burner can provide heat to drive the system. While in this case fuel is being burned the operation is still profitable to the homeowner because about $\frac{1}{3}$ of the heat available in the fuel is converted to electrical energy which is a more expensive type of energy than BTU's in hot water.

The horsepower output is improved in the present invention by use of a rotary engine to provide a multiplicity of contracting and expanding chambers per revolution of the output shaft.

While several configurations of a scissor action rotary engine would provide the desired multiplicity of expansion/contraction chambers the Tri-Rotor configuration is preferable. This type of engine has been described in the previous patent entitled *Three Rotor Engine* U.S. Pat. No. 3,985,110 and U.S. Pat. No. 4,167,922 entitled Internal Ballistic Engine. A detailed structure for advanced design of a Tri-Rotor engine is also shown in a recent U.S. Pat. No. 4,169,697 entitled Angular Compresion Expansion Cylinder with Radial Pistons.

An important advantage of the Tri-Rotor concept is that a full two-drum Tri-Rotor engine provides 32 strokes per revolution of the output shaft. By assigning one drum to the hot region and the other to the cold region and by interposing a regenerator, the Tri-Rotor engine naturally yields itself into a continuous-flow Stirling cycle engine where effectively each region is being operated by eight cylinders.

The horsepower output of the Tri-Rotor Stirling engine can therefore be eight times greater than that of the conventional Stirling engine, of equal volume per cylinder. Yet as the space inside the Tri-Rotor engine is used very efficiently, the size of the Tri-Rotor engine is not being increased proportionately to the increase of horsepower output.

In order that the regenerator service the said multiplicity of contraction/expansion chambers, the present invention provides bi-directional regenerator means. Thus the working fluid being cooled after exiting the engine, can flow simultaneously with working fluid being pumped back to the hot region feeding the engine with some reservoir space in the intake and exhaust of the Tri-Rotor engine the process of regeneration is becoming continuous in the present invention. This feature can greatly increase the amount of working fluid being processed by the regenerators, while, actually permitting a decrease of the regenerator size and weight per horsepower output. This is accomplished by the fact that the regenerator in the present invention acts more as a heat exchanger between the working fluid flowing through it in opposite directions rather than acting as a heat storage device, which is the case in the conventional Stirling engine. The regenerator in the present invention has the function of maintaining a temperature gradient transferring heat from the working fluid which exits the Tri-Rotor and flowing downhill along the temperature gradient, to the working fluid returning to the hot region, flowing uphill along the temperature gradient.

Another improvement in the Stirling engine provided by the present invention is in the area of the heat exchanger where the working fluid is being cooled to its lower temperature in the system. The present invention provides an active rather than a passive heat exchanger where the working fluid is forced along the cool fins of the heat exchanger by revolving impellers which impart rotation and centrifugal force to the working fluid for a highly efficient transfer of heat from the working fluid to the cooling medium, which is usually water.

Accordingly an object of the present invention is to provide an external combustion engine multi-cylinder Stirling Engine comprising:

a heat source;

a hot container defining a hot region containing working fluid at temperature $T_1$ and pressure $P_1$; a heat exchanger transferring heat from the heat source to the hot region;

expansion means, where hot working fluid of initial temperature $T_1$ and pressure $P_1$ is allowed to expand while its temperature is reduced to $T_2$ and pressure to $P_2$, providing work;

a bidirectional regenerator, sustaining a thermal gradient $T_2$ and $T_3$ so that as the working fluid flows from a high temperature to a lower temperature, its temperature is being lowered from $T_2$ to $T_3$ while heat is being transferred and stored from the working fluid into the substance of the regenerator, and in the working fluid traveling in the opposite direction through the regenerator, raising its temperature from a low temperature $T_3$ to a higher temperature $T_2$; a heat exchanger, where the working fluid is further cooled to a temperature $T_4$ for the purpose of having its effective density increased;

pumping means to return the working fluid back to the hot region of pressure $P_1$, through the regenerator, and a rotatable heat exchanger for efficient transfer of heat from the working fluid to a coolant medium, such as water, comprising impeller blades for imparting rotation and centrifugal force to the working fluid and fins preferably forming a helical track for the working fluid to follow for efficient transfer of heat.

A further object of the present invention is to provide an external combustion engine which can be connected to the ultimate driven members of a vehicle, such as its wheels or be connected thereto through a simplified transmission.

A further object of the present invention is to provide an external combustion engine for conversion of solar energy into mechanical work.

A still further object of the present invention is to provide an efficient external combustion engine for conversion of heat provided by a fuel burner into mechanical work.

Another object of the present invention is an external combustion engine utilizing a rotary engine such as a Tri-Rotor engine configuration for compression and expansion of the working fluid, thereby providing a high efficiency, low pollution engine, with a horsepower output several times that expected from a conventional Stirling engine.

A still further object of the invention is a modified Stirling engine utilizing a full two-drum Tri-Rotor engine to provide a multiplicity of contracting/expanding chambers of a first drum for converting some of the high temperature and pressure of the working fluid into work, while providing contracting/expanding chambers of a second drum to pump the cool working fluid back to the input of the first drum.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there is illustrated a preferred embodiment of the invention.

DESCRIPTION OF THE PREFERRED EMBODIMENTS

Figures 1A, 1B, 1C:
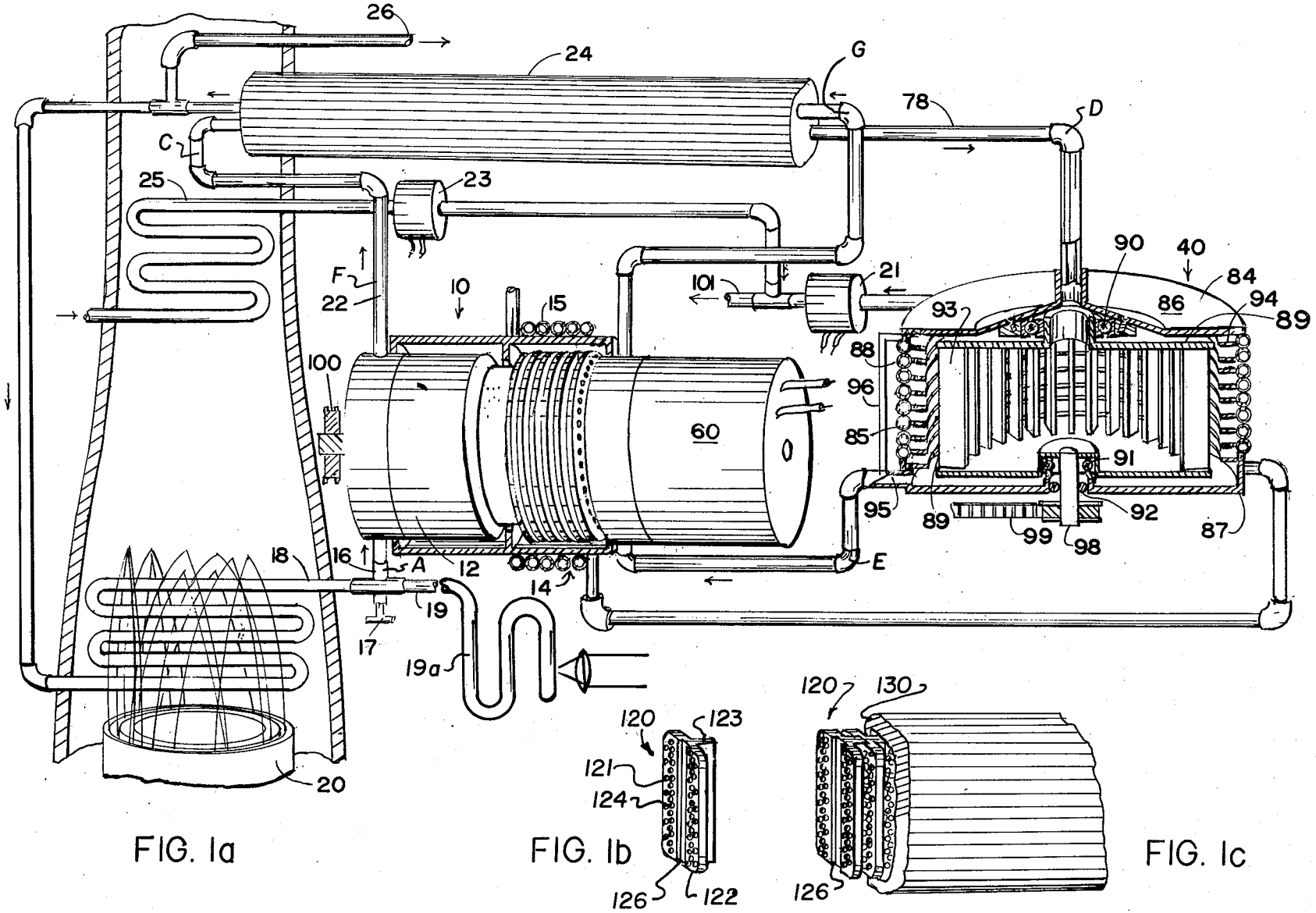
FIG. 1*a* is a side perspective view of a first preferred embodiment of the invention with portions cut away for clarity.
FIG. 1*b* is a fragmentary portion of FIG. 1*c*.
FIG. 1*c* is a fragmentary portion of FIG. 1*a*.

Referring now to the drawings in particular the invention embodied therein in FIG. 1*a* comprises a main engine generally designated 10 and explained in more detail later. Comprising expansion/compression chambers 12 and pumping means 14.

The main engine 10 may take various forms. For example, the main engine may be implemented by a pair of turbines, a first turbine providing for expansion of the working fluid whereby a substantial portion of the energy of the working fluid, e.g. water vapor or air, is being converted into work; while a second turbine provides for the compression needed to return the working fluid to a high temperature heat exchanger 18. The main engine 10 may also be implemented by linear piston means.

A preferred embodiment of this invention for a main engine 10 comprises a Tri-Rotor engine to be explained later in conjunction with FIG. 4. The high temperature heat exchanger 18 transfers heat energy from a heat source such as a fuel burner 20 to the working fluid circulating inside it. The heat raises the temperature of the working fluid to a temperature $T_1$ and its pressure to a pressure $P_1$. The high temperature high pressure fluid enters the expansion/contraction chamber 12 through intake means 16.

Figure 4:
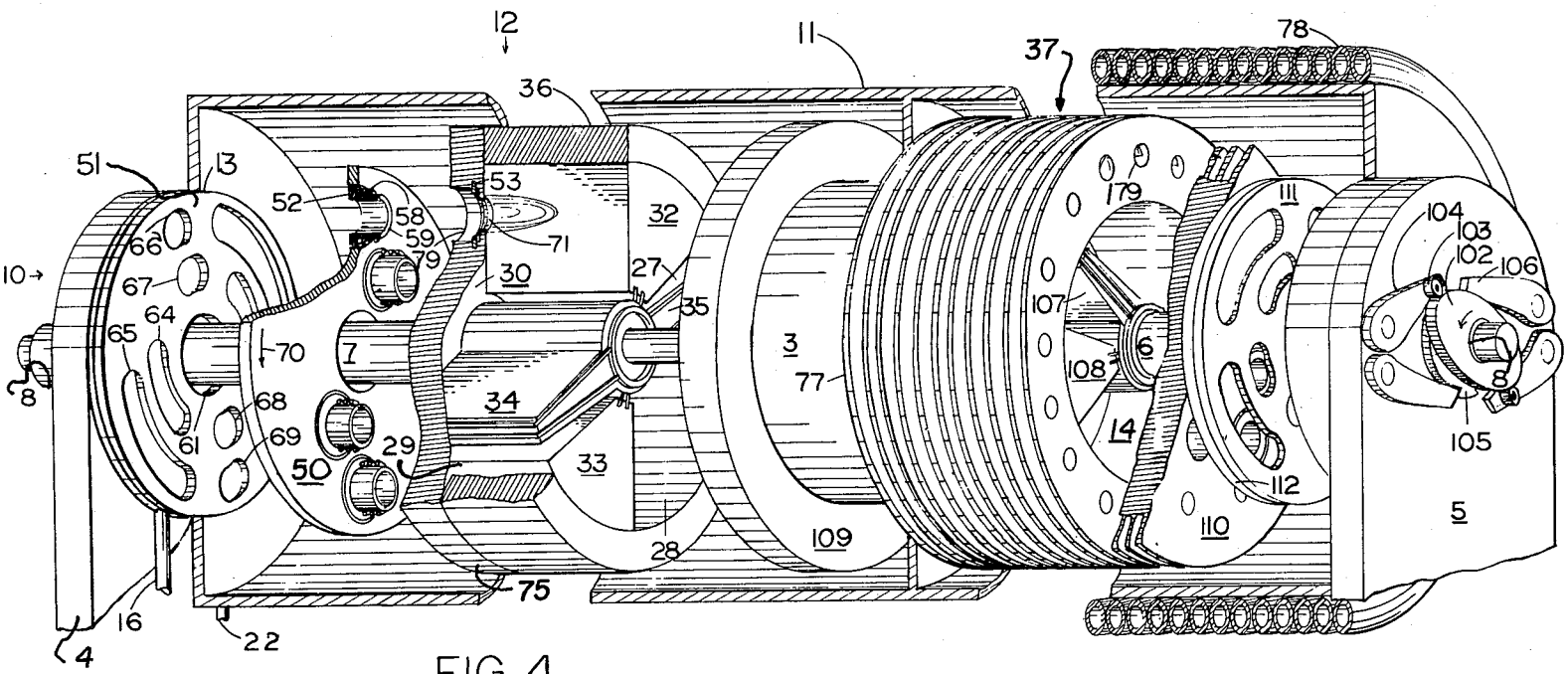
FIG. 4 is a side perspective and exploded view of the Tri-Rotor configuration suitable as an essential component of the present invention of FIGS. 1*a* and 2 with portions cut away for clarity; and, FIG. 5 is a Pressure-Volume cycle diagram showing the thermodynamic steps performed by the system shown in FIGS. 1*a* and 2 of the invention.
Figure 5:
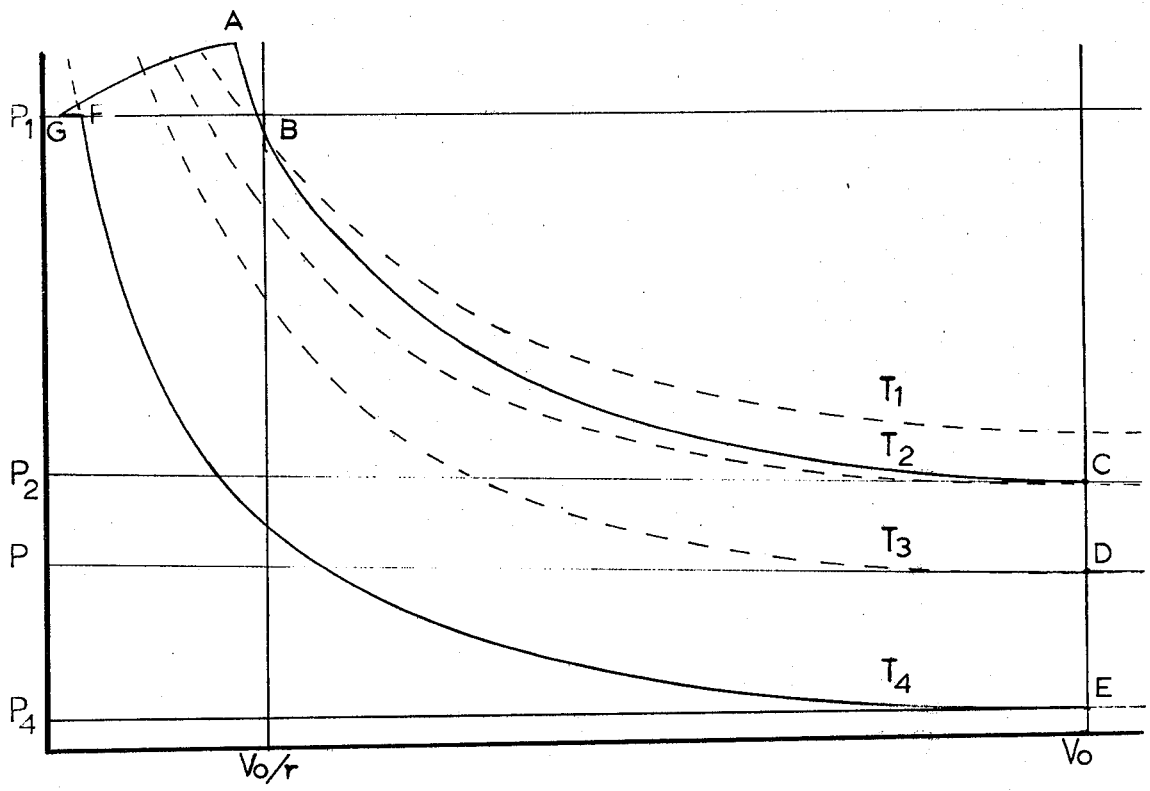

FIG. 5 shows the thermodynamic steps accomplished in FIG. 1*a* in terms of the pressure vs volume relationship of the working fluid. The intake 16 of FIG. 1*a* corresponds to point B of FIG. 5. Point G in FIG. 5 indicates the state of the working fluid as it enters the high temperature heat exchanger 18 at point G of FIG. 1*a*. The path GA in FIG. 5 represents the heating of the working fluid through the heat exchanger 18 from point G to 16 of FIG. 1*a*. The small reduction in pressure from point A to point B shown in FIG. 5 is caused by the small increase in volume as an intaking internal chamber 30 as shown in the Tri-Rotor engine of FIG. 4. The chamber 30 expands from a minimum volume at point A to a volume $r_o$ at point B. At point B communication of the heat exchanger 18 with the expanding chamber 30 is interrupted. The work performed during the interval from point A to B is $W_{AB}$ as shown in the following equation.

$$W_{AB}=P_1V_o(1-r/r_o)/r \quad (1)$$

Where r is the working compression ratio and $V_o$ is the maximum volume of the chamber 30. The work performed $W_{AB}$ is imparted from the hot working fluid to the main engine 10.

During the next step, from point B to C the chamber 30 shown in FIG. 4 expands adiabatically with the working fluid imparting more energy in the form of work. This work designated as $W_{BC}$ during the interval from B to C is as shown in the following equation:

$$W_{BC}=(P_1V_o/r-P_2V_o)/(K-1) \quad (2)$$

where K is the ratio of specific heats $c_p/c_v$ of the working fluid. This loss of energy from the working fluid causes the temperature of the working fluid to fall from $T_1$ to a new temperature $T_2$ at pressure $P_2$ shown in FIG. 5.

The power stroke corresponding to the expansion of chamber 30 of FIG. 4 lasts from point A to point C of FIG. 5 at which point the chamber 30 has reached its maximum volume and starts contracting. The working fluid as it is being exhausted by chamber 30 is guided through conduit 22 of FIG. 1*a* to the first chamber of a regenerator 24, as explained in more detail later. The regenerator 24 serves to maintain a temperature gradient $T_2$ to $T_3$, so that as the working fluid flows inside the regenerator its temperature falls from $T_2$ to $T_3$. As the working fluid flows inside the regenerator its pressure falls from a pressure $P_2$ to a lower pressure $P_3$.

The working fluid then enters through conduit 78 of FIG. 1*a* a low temperature heat exchanger 40, as explained in more detail later, for further cooling of the fluid to a temperature $T_4$. The purpose of cooling the gas is to increase its effective density thus lowering the effective volume and therefore the amount of work needed to return the gas to its original point A. The effective volume dV' at temperature $T_4$ and pressure $P_1$ of the working fluid which occupies a volume $V_o/r$ at temperature $T_1$ and pressure $P_1$ is given by the equation:

$$dV'=V_oT_4/(rT_1) \quad (3)$$

As the work for compression or expansion is equal to $P_1$ dV, (the effective volume times the pressure) the ratio of the work for compressing back the working fluid to point A divided by the original work $W_{AC}$ is equal to $T_4/T_1$, the ratio of the absolute temperatures. The higher the ratio of $T_1/T_4$ the higher the efficiency of operation.

As the working fluid was cooled to the temperature $T_4$ shown in FIG. 5, its pressure was reduced to $P_4$. It may be noted that since work is the product of pressure times the change in volume and since there is no change in volume in the interval CE there is no work involved during these processes.

Figure 2:
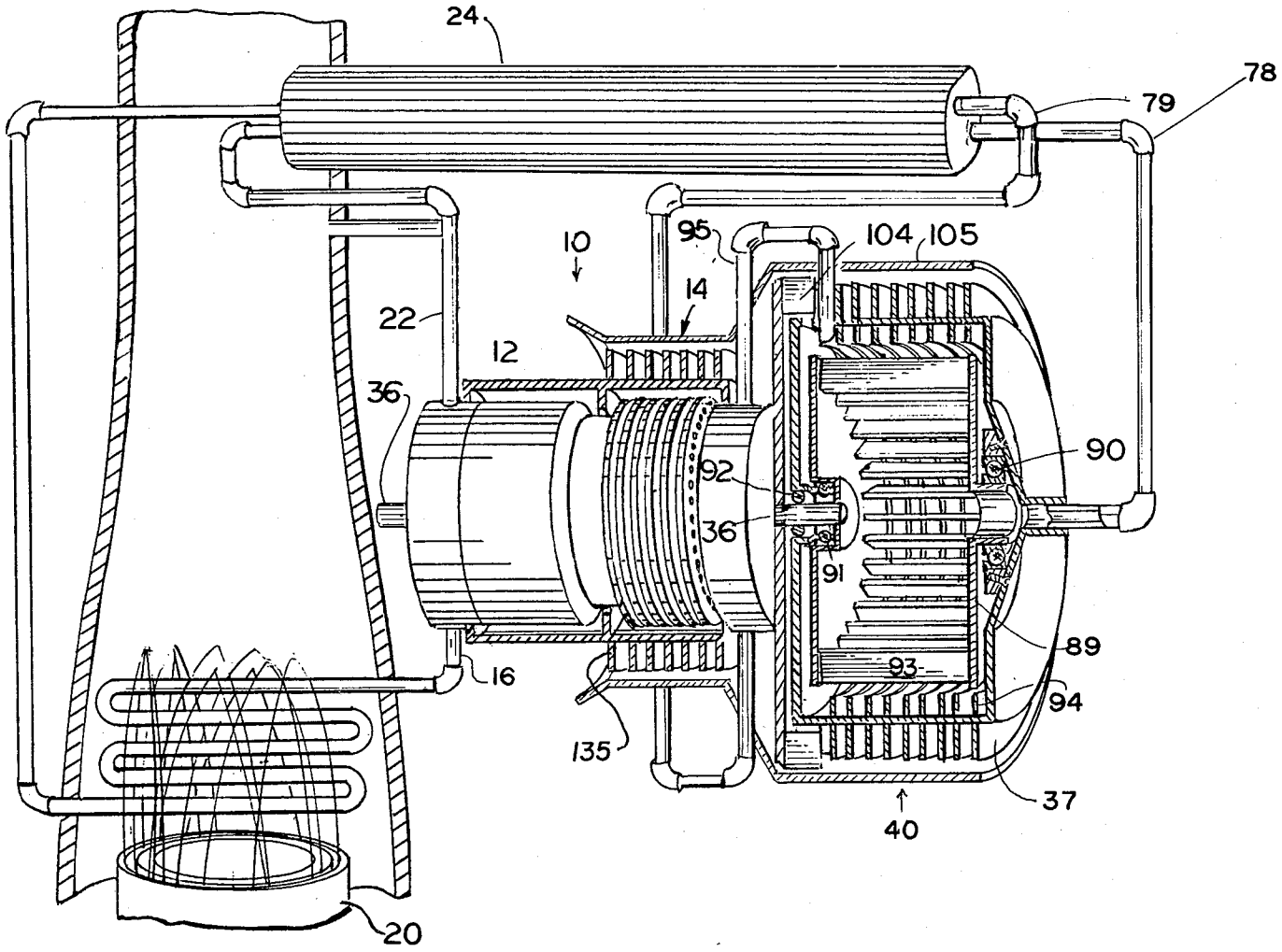
FIG. 2 is a side perspective view of a second preferred embodiment of the invention with portions cut away for clarity.

The working fluid is next pumped through the contraction/expansion chambers of the second drum of the Tri-Rotor engine or pumping means 14 shown in FIGS. 1*a*, 2, and 4 back to pressure $P_1$. Pumping means 14 of the Tri-Rotor engine is kept at temperature $T_4$ by a heat exchanger generally designated 15 and explained in more detail later.

Pressurizing the working fluid under constant temperature is an isothermal process requiring work to be performed by the engine onto the working fluid. This work during the interval from point E to F of FIG. 5 or $W_{EF}$ is shown in the following equation:

$$W_{EF} = -P_1 T_4 V_o \ln (T_1/(rT_4))/(rT_1) \quad (4)$$

The working fluid at point P shown in FIG. 1*a*, 2, and 5 (while at high pressure $P_1$) still needs additional work for its effective volume dV' given by equation (3) to be inserted into the hot region inside the heat exchanger 18. This loss of work by the engine from point F to G is shown by the following equation:

$$W_{FG} = -P_1 V_o (T_4/T_1 - r/r_o)/r \quad (5)$$

The remaining path GA of FIG. 5 is accomplished with further increase in pressure due to the addition of thermal energy by the reverse travel of the working fluid through the regenerator and due to the addition of thermal energy through the heat exchanger 18. Actually the path GAB is a complicated process occuring as heat energy is entering the heat exchanger 18 raising both temperature and pressure, while intaking by the engine 10 tends to slightly lower these parameters, so that the position of A on the P-V diagram of FIG. 5 varies with time.

It is to be noted that while in FIG. 1 the heat exchanger 18 is shown to receive heat by flames from a burner 20, the invention is not restricted to any particular type of heat source. Heat exchanger 18, for example, may receive heat from solar light, properly focused on to the heat exchanger.

FIG. 1*a* shows the capability of feeding the engine 10 at the intake 16 by more than one source of heat energy. Port 19, for example, may be connected to a solar energy collecting heat exchanger 19*a*, while valve 17 may switch to a partial or total thermal input by the fuel burner 20. Conduit 26 serves as a return to the solar energy collector. This arrangement can be very useful in the case where the invention is to be used for effectively converting solar heat to mechanical work which can then easily be converted to electricity. During cloudy days and darkness the system can easily be switched to the backup fuel burner 20.

Referring now to FIG. 4 the preferred type of main engine 10, shown with the invention is of the two drums Tri-Rotor engine configuration, providing power expansion chamber 12 where the hot working fluid is allowed to expand yielding work. The main Tri-Rotor engine 10 preferably provides valve means 13 for stopping the working fluid from entering the expansion chamber at a predetermined point of the stroke, after which point the chamber is allowed to expand adiabatically so that a substantial amount of the energy which is contained into the hot working fluid is converted into work.

As shown in FIG. 4 the contraction-expansion chambers are formed angularly between two pairs of radial pistons. One pair, the "outer" piston, 32 and 33, is attached to the inner surface of a constant speed drum 36 which is rigidly connected and rotating with the output shaft 8. The second pair, the "inner" pistons, 34 and 35 are attached to an inner rotor 7 concentric to the output shaft 8. The inner pistons 34 and 35 are operating inside the drum 36 and are interleaved with the outer pistons, 32 and 33 thus dividing the space within the drum into four angularly expanding/contracting chambers 27, 28, 29, and 30.

A similar configuration as the contraction-expansion chamber 12 is provided by the Tri-Rotor engine 10 as the pumping means 14 shown at the right side of FIG. 4. This pumping means 14 comprises an inner rotor 6, four chambers and pistons such as inner piston 107 and outer piston 108.

The Tri-Rotor engine operates along the principles of a differential gear assembly, in which the drum-and-output-shaft combination (which comprise one rotor) correspond to the idler gears. The inner rotor, 7 and 6 corresponds to one of the side gears.

As the outer pistons and output shaft of both drums rotate with an angular velocity $w_o$ radians/sec. the angular velocity of a pair of inner pistons such as inner pistons 34, 35 varies from 0 to 2 $W_o$ radians/sec (with respect to ground) causing the inner piston to effectively oscillate between the outer pistons 32 and 33. This oscillation is manifested as a sequential angular contraction/expansion of each of the four chambers, 27, 28, 29, and 30 as more fully described in the prior Tri-Rotor patents mentioned before.

The engine 10 has two stationary sides 4 and 5 which house intake and exhaust ports and provide rigid supports to ground. The stationary sides also serve to define four quadrants corresponding to the strokes of the cycle performed by the engine, "power," "exhaust," "power," "exhaust" in the case of the external combustion engine. Which particular stroke, each of the four chambers executes at a particular instant, can be determined by its rotational position with respect to the stationary quadrants. Thus, for example, as each of the four chambers traverses the "power" quadrants, it provides a power stroke. With four chambers going through the two power quadrants during each revolution, we have eight power strokes per revolution of the output shaft.

The Tri-Rotor engine is lighter and smaller in size than the conventional Linear Piston engine. For example, compared to a linear piston engine the block of eight cylinders (each four inches in diameter in the case of a V8 350) can be replaced with a single cylinder of 7.5 inches in diameter and three inches in axial length. Also, the crankshaft, the popping valves, the extensive manifolds, and the cooling fan of the conventional piston engine are eliminated in the case of the Tri-Rotor engine. The result is an engine with the efficiency of about 200 hp per cubic foot which weighs one fourth of the weight of a linear piston gasoline engine of the same horsepower.

In the adaptation of the Tri-Rotor engine configuration as an external combustion engine shown in FIG. 4 the timing of the strokes is determined by the stationary slot plate 13 which is securely attached to the stationary support 4. The plate 13 provides a hole 61 to allow for exit of the output shaft 8. The plate 13 also provides 8 slots out of which slots 62, 63, 64 and 65 used for exhaust while slots 66, 67, 68 and 69 are used for intake of the working fluid. These slots define the arc during which communication is to exist between a contraction-/expansion chamber such as 27, 28, 29 or 30 and the intake or the exhaust. It may be noted that a single port per chamber provides both intake and exhaust. For example, port 71 substantially covered by the outer piston 32 so that the port lies outside the travel of the inner piston 34, provides intake and exhaust to chamber 30. Similarly, a second port (not shown) substantially covered by the outer piston 33 provides intake and exhaust to chamber 29.

As adjacent chambers such as 30 and 27 are at different strokes, one contracting the other expanding, slots 62 and 63 are at different distances from the axis of the engine, thus port 71 is at a greater distance from the axis than the second port. A third port (not shown) symmetrically located to the second port with respect to the axis of the engine, on the right side of the outer piston 32, provides intake and exhaust to chamber 27, while a fourth pot symmetric to port 71 on the right side of the outer piston 33 provides intake and exhaust to chamber 28. The four ports 71 etc. are cylindrical openings on the base plate 75 of the drum 36.

Referring again to FIG. 4 a plate 50 supported by, and rotated with the drum 36 has the purpose of keeping the eight slots on the slot plate 13 covered except at the locations where the four port holes such as port hole 71 coincide with a slot such as slot 62. Opposite the four ports such as port 71 there is a cylindrical hole 79 on the plate 50, inside which it fits a port cylinder such as port cylinder 59 through a piston ring such as piston ring 52 for proper sealing. The same port cylinder such as cylinder 59 slides inside a cylindrical opening 79 through a piston ring such as ring 53, for sealing. Springs such as spring 58 keep the four port cylinders such as port cylinder 59 biased against a surface 51 of the slot plate 13. The port cylinders such as cylinder 59 therefore serve to interface between the slots and the intake and exhaust ports of the chambers. A space between the plates 75 and 50 is used as take up for the expansion of the engine as it warms up.

As the drum 36 rotates in the direction as shown by arrow 70, and while the rotor 7 carrying the pistons 34 and 35 is held fixed, the outer piston 32 approaches the inner piston 34 with a rotational velocity $w_o$. The chamber 30 undergoes an exhaust stroke and the working fluid inside the chamber 30 is being exhausted through the port cylinder 59 and slot 62 which communicates with the exhaust conduit 22 shown in FIGS. 1*a* and 2.

Upon completion of the exhaust stroke an intake stroke follows as the port cylinder 59 traverses over the slot 66. This slot is short, interrupting intake so that only a portion $V_o/r$ of the maximum volume of the chamber $V_o$ is being filled by the hot working fluid.

The remaining expansion of the chamber to full volume $V_o$ at 90 degree is accomplished through an adiabatic expansion. Letter r then represents the compression ratio of the adiabatic expansion. The power stroke starts with the intake stroke. While the intake stroke lasts only for 90 $V_o/r$ degrees of chamber expansion the power stroke extends to the full expansion of 90 degrees. Expansion of the chamber 30 is being accomplished by holding rotor 6 fixed so that due to the connection of rotor 7 through a differential 3 when in FIG. 4 the rotor 7 rotates in the direction of the arrow 70 at a rotational velocity 2 $w_o$ with respect to ground. The expanding chamber 30 then expands at a rate $w_o$.

It may be noted that with ports and slots being symmetrical with respect to the axis of the engine and each cycle comprising only two strokes, every other chamber such as chambers 30 and 28 are undergoing the same stroke. Thus there are eight intake/power strokes and eight exhaust strokes per each revolution of the output shaft 8, per each drum of the Tri-Rotor engine.

A second drum 37 of the Tri-Rotor engine shown in FIG. 4 is of substantially similar internal construction as drum 36. The size of the chambers of drum 37 is smaller than those of the drum 36 by a factor of $T_4/T_1$. This is because the working fluid being denser while in drum 37 than in drum 36 by a factor of $T_4/T_1$. That drum 37 needs that much smaller displacement volume to be returned back to the interior of the high temperature heat exchanger 18. Slot plate 111 on the compression side of the Tri-Rotor engine, next to the drum 37, is essentially similar to plate 13, except that all slots extend to cover the full 90 degree duration of the stroke. Thus the slots corresponding to the expansion strokes such as the slot 66 are of the same full length as the slots 62 corresponding to contraction strokes.

The drum 37 has fins 77 radially extending outwardly. Axially oriented holes 79 allow air to enter from the sides and to escape radially through the fins, due to the centrifugal force imparted by the rotational motion of the drum 37.

A sealing cover 11 extends across from stationary sides 4 and 5. While the cover 11 outside the drum 36 provides insulation to prevent heat from being wasted, the cover 11, outside the drum 37 serves as a heat exchanger whereby circulating water keeps the drum 37 at the low temperature $T_4$.

Heat exchanger between the drum fins 77 and the water circulating in the body of the sealing cover 11 outside the drum 37 is accomplished as the air circulating through the holes 179 and fins 77 is thrown against the internal surface of the cover 11 under the influences of the centrifugal force imparted to the air by the rotating drum 37. The various configurations that the differential 3, engaging the two rotors 7 and 6 can take, have been described in detail in the U.S. Pat. Nos. 3,989,012 and 4,169,697.

FIGS. 1*b* and 1*c* show a relatively simple construction of the heat exchanger 24. A metallic element 120 provides a dividing wall section 123 for dividing the space inside the regenerator 24 into two chambers. Fins 121 and 122 extend normally from the dividing sectional wall 123 one in each chamber. Holes 124 on each of the fins 121, 122 permit passages and interaction of the working fluid through the regenerator element 120. The element 120 provides on one side a female groove 126 so that it can mate with the wall 123 of the next element, as shown in FIG. 1*c*.

Cement may be used without any deterioration in performance for joining one element 120 to the next. A jacket 130 preferably made out of an elastomeric material is build outside the elements 120 to make up the main body of the regenerator 24. A preferred design and construction for the regenerator 24 is shown in FIG. 3.

Figure 3:
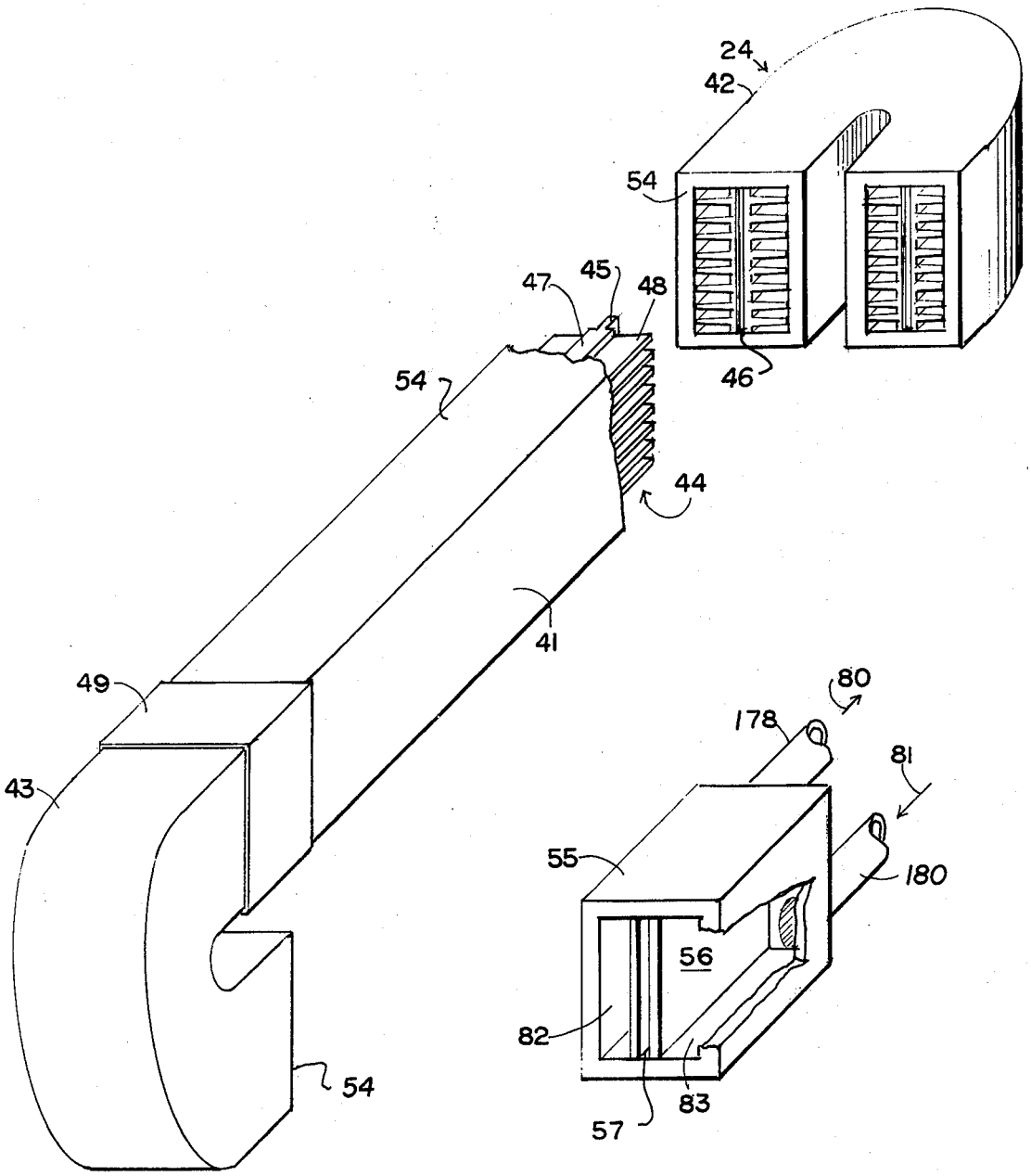
FIG. 3 is a side perspective and exploded view of a preferred alternate regenerator of FIGS. 1*a* and 2 of the invention with portions cut away for clarity.

Referring now to FIG. 3, the regenerator 24 comprises straight sections 41, an x-coordinate 180 degree bend 42 and a y-coordinate 180 degree bend 43. The straight section 41 comprises a metallic extrusion 44 machined at each end to provide male plug ending 45 for plugging into a female receptor 46. The extrusion 44 further comprises a metallic dividing wall 47 serving to separate the transmission line of the regenerator into two chambers so that the working fluid returning through the regenerator can flow in opposite direction than the working fluid originally going through and depositing heat in the regenerator.

Fins 48 extend normally from the wall 47 serve to increase the surface of interaction between the working fluid and the regenerator. These fins 48 may be tapered at the ends to save material and weight.

The x-coordinate 180 degree bend 42 serves to adapt one straight section 41 to a next straight section of same level. Thus providing a plurality of convolutions in the overall system of the regenerator.

The dividing wall 47 as well as the fins 48 continue inside the bend 42. Various metal processes such as casting, machining and brazing may be used in the construction of the metallic portion of the bend 42.

The y-coordinate bend 43 serves to adapt one layer of the regenerator to a next layer. Both the dividing wall 47 and the fins 48 are being continued inside the bend 43. The separating wall also provides at the ends receptacles such as receptacle 46 for mating with the male endings 45 of the straight sections such as section 41. Cement may be used during assembly on the surface of the plug 45 for both sealing and permanently securing the joint.

The metallic portions of the sections 41, 42 and 43 are covered by an insulating jacket 54, which can be preferably elastomeric. The jacket 54 may be reinforced, externally. Wire or other thin metallic strip wound outside along the entire length of the elastomeric jacket may provide such reinforcement.

Bands 49 in conjunction with adhesives may be used to retain the various sections of the regenerator together. The bands 49 may be made out of shrinkable material which will become tighter with the application of heat.

Referring again to FIG. 3, an adapter 55 is provided comprising separating wall 56 for the purpose of continuing the dividing wall 47 of the straight section through a female receptacle 57 which mates with a male plug such as 45. Tubular endings 178 and 180 are provided connecting two chambers 82 and 83 with the conduits shown in FIGS. 1*a* and 2. It shall be noted that one adapter such as adapter 55 will be needed at each end of the regenerator 24.

Turning now back to FIG. 1, the heat exchanger 40 following the regenerator 24 may take any configuration normally used for heat exchangers such as the well known type using metallic tubular conduits for the flow of the coolant with fins extending from them for better interaction with the gaseous working fluid. FIG. 1 shows a preferred design for the heat exchanger 40 comprising a metallic cylindrical container 84 having a cylindrical wall 85 and base covers 86 and 87.

The preferable construction of the side wall 85 comprises a tube 88 made out of a heat condctivity metal such as copper, helically wound and brazed to form a cylinder. The tube 88 provides as part of it a fin 94 positioned during the winding to point inwardly towards the axis of the cylinder, forming a continuous helix which starts near the upper base 86 and ends near the lower base 87 of the container 84.

Supported by the upper and lower bases 86 and 87 through bearings 90 and 91 respectively, is a cage 89 providing impellers 93, properly formed so that as the cage rotates the working fluid is forced to rotate. The centrifugal force caused by the rotation, forces the fluid against the wall 85 where the helical fin track transfers heat from the fluid to the coolant, flowing inside the tube 88, while the helical fin 94 guides the fluid along the cylindrical wall from the upper base 86 to the lower base 87.

The working fluid exits at the port 95 to be processed for compression by the pumping means 14 of the Tri-Rotor engine 10. If the temperature of the working fluid is greater than the desired temperature $T_4$ a recirculation bypass 96 can allow bypass of part of the fluid to be recirculated through the centrifugal heat exchanger once more.

A seal 92 prevents loss of pressure as the cage 89 is being rotated through a shaft 98. The shaft 98 is driven by a pulley/belt arrangements 99 which in turn is engaged with the output pulley 100 of the Tri-Rotor engine 10, through an intermediate idler pulley, (not shown). In this manner the rotation of the centrifugal heat exchanger 40 is proportional to the rotation of the Tri-Rotor engine.

The specific configuration of the invention shown in FIG. 1 depend on the particular application for which such system is intended. For example, when the invention is to be used for conversion of heat to mechanical work for the production of electricity at home with a fuel burner providing the heat, the hot water can be used for heating the housing during the winter, providing air conditioning during the summer through an absorption type refrigeration cycle and hot faucet water the year around. In this case besides a high temperature heat exchanger 18, a low temperature heat exchanger 25 can collect substantial heat that would otherwise have been lost up the chimney. This heat, together with the heat being transferred from the working fluid in the heat exchanger 40 to water, used as the coolant, can be used at the output 101 for the uses as hereinbefore mentioned. The hot water flow output at 101 can be controlled automatically by pumps 21 and 23.

When the invention is being used as an automotive engine, as shown in FIG. 2, and if water is used as a coolant most of the hot water must be cooled by an additional heat exchanger (not shown). Depending on the detailed considerations of the design of such system, both heat exchangers 40 and 135 may be air cooled. In this embodiment the cage 89 of the centrifugal heat exchanger 40 can be driven directly by one end of the output shaft 36 of the Tri-Rotor engine 10, while the other end of the shaft 36 can be engaged with the transmission of the automobile.

While preferred embodiments of the present invention have been described in detail it will be understood by those skilled in the art that various modifications can be made therein without departing from the principles of the invention.

What is claimed is:

1. A multi-cylinder stirling cycle engine comprising:

heater means for heating a working fluid to a working temperature;

a high temperature heat exchanger associated with said heater means for carrying the working fluid past said heater means to bring the working fluid to the working temperature;

rotary expansion chamber means having an input connected to said high temperature heat exchanger for receiving the working fluid at the working temperature and reducing the temperature thereof to produce work;

a bidirectional regenerator connected to an output of said rotary expansion chamber means for carrying the working fluid in a first path and further reducing the temperature thereof;

a low temperature heat exchanger connected to said regenerator for receiving the working fluid and still further reducing the temperature thereof;

rotary compressor chamber means connected to said low temperature heat exchanger for receiving the working fluid from said low temperature heat exchanger and compressing it to a working pressure, said rotary compressor chamber means having an output connected to said regenerator;

said regenerator receiving the working fluid from said compressor means output and carrying it in a second path in counter current flow relationship with said first path to heat the working fluid from said compressor means and cool the working fluid from said rotary expansion chamber means;

said high temperature heat exchanger connected to said regenerator for receiving the heated working fluid;

said rotary expansion chamber means being connected to said rotary compressor chamber means, said rotary expansion chamber means and said rotary compressor chamber means having a common rotating shaft on which the work produced is applied and, said regenerator comprising an insulating housing, a heat conductive dividing wall extending in said insulating housing dividing said housing into first and second parallel passages, and a plurality of heat conducting fins extending normally from said dividing wall forming said first and said second parallel passages, the working fluid moving in said first passage in said first path and in said second passage in said second path.

2. An engine according to claim 1 wherein said bidirectional regenerator comprises at least one straight section and at least one bend section connected to said straight section.

3. An engine according to claim 2 wherein said bend section comprises a Y-plane bend section, said regenerator including at least one additional X-plane bend section interconnecting said straight section with at least one additional straight section whereby a plurality of said straight sections can be stacked.

4. An engine according to claim 1 wherein said wall and fins comprise separate wall and fins structures which are interconnectable with each other.

5. A multi-cylinder stirling cycle engine according to claim 1 wherein said fins extending normally from said dividing wall extend parallel to the directional flow of said bidirectional regenerator.

6. A multi-cylinder stirling cycle engine according to claim 1 wherein said fins extending normally from said dividing wall extend normally to the directional flow of said regenerator and wherein said fins including a plurality of apertures therethrough for the passage of the working fluid.

* * * * *